US010711659B1

(12) United States Patent
Bell

(10) Patent No.: US 10,711,659 B1
(45) Date of Patent: Jul. 14, 2020

(54) DRIVE ADAPTER FOR CONCENTRIC CAMSHAFT ASSEMBLY

(71) Applicant: SCHAEFFLER TECHNOLOGIES AG & CO. KG, Herzogenaurach (DE)

(72) Inventor: Shannon Bell, Sterling Heights, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/364,873

(22) Filed: Mar. 26, 2019

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 2001/0473* (2013.01); *F01L 2001/34469* (2013.01); *F01L 2001/34483* (2013.01); *F01L 2101/00* (2013.01)

(58) Field of Classification Search
CPC ..... F01L 1/3442; F01L 2001/0473; F01L 2001/34469; F01L 2001/34483; F01L 2101/00
See application file for complete search history.

(56) References Cited

U.S. PATENT DOCUMENTS 8,113,159 B2 2/2012 Myers et al.
8,336,512 B2 12/2012 Myers et al.
2009/0183702 A1* 7/2009 Knecht ..... F01L 1/022 123/90.15
2010/0089353 A1 4/2010 Myers et al.
2012/0031358 A1* 2/2012 Knecht ..... F01L 1/3442 123/90.15

* cited by examiner

*Primary Examiner* — Zelalem Eshete
(74) *Attorney, Agent, or Firm* — Brooks Kushman P.C.

(57) ABSTRACT

A camshaft phaser for a concentric camshaft assembly includes a stator defining a cavity and configured to receive power from an engine crankshaft. A rotor is supported within the cavity and is rotatable relative to the stator. A drive adapter has a shank and a head. The shank is extendable through the rotor and is configured to engage with an inner camshaft. The head has an end face defining a first key feature and a continuous groove. A drive plate is fixed to the stator and includes a radial wall defining a second key feature engageable with the first key feature to rotationally fix the drive adapter to the drive plate. An annular gasket is received in the groove and is sealable with the wall.

20 Claims, 4 Drawing Sheets

DRIVE ADAPTER FOR CONCENTRIC CAMSHAFT ASSEMBLY

TECHNICAL FIELD

The present disclosure relates to concentric camshaft assemblies and more specifically to drive adapters for camshaft phasers.

BACKGROUND

Internal combustion engines include a plurality of cylinders having pistons disposed therein. The pistons are connected to a crankshaft that outputs power produced by the engine. The cylinders have associated intake and exhaust valves that introduce a fuel-air mixture into the cylinders and expel combusted gases, respectively. The valves are controlled by one or more camshafts. The camshafts are driven by the crankshaft and synchronized to the crankshaft so that the valves open and close at the appropriate times. Traditionally, the timing of the camshaft relative to the crankshaft was fixed. Many modern engines, however, include variable valve timing (VVT) to improve performance and/or fuel economy. Engines equipped with VVT may include one or more camshaft phasers (also known as variators) that adjust the position of associated camshafts relative to the crankshaft to vary valve timing.

SUMMARY

According to one embodiment, a camshaft phaser for a concentric camshaft assembly includes a stator defining a cavity and configured to receive power from an engine crankshaft. A rotor is supported within the cavity and is rotatable relative to the stator. A drive adapter has a shank and a head. The shank is extendable through the rotor and is configured to engage with an inner camshaft. The head has an end face defining a first key feature and a continuous groove. A drive plate is fixed to the stator and includes a radial wall defining a second key feature engageable with the first key feature to rotationally fix the drive adapter to the drive plate. An annular gasket is received in the groove and is sealable with the wall.

According to another embodiment, a camshaft phaser includes a stator defining a cavity and configured to receive power from an engine crankshaft. The phaser also includes a rotor supported within the cavity and rotatable relative to the stator. The rotor is configured to be rotationally fixed to an outer camshaft so that rotation of the rotor relative to the stator adjusts a phase angle of the outer camshaft. A drive adapter of the phaser has a shank extending through the rotor and configured to be rotationally fixed to an inner camshaft. The drive adapter further has a head with an end face defining a first key feature and a continuous groove. A drive plate is fixed to the stator and includes a radial wall defining a second key feature engaged with the first key feature to rotationally fix the drive adapter to the drive plate so that the inner camshaft is rotatable with the stator. A gasket is received in the groove and disposed against the wall.

According to yet another embodiment, a camshaft phaser includes a stator, a rotor configured to engage with an outer camshaft, and a drive adapter extendable through the rotor and configured to engage with an inner camshaft. The drive adapter includes a head defining a groove. A drive plate is rotationally fixable to the stator and the drive adapter. The drive plate has a wall facing the head. A gasket is received in the groove and is sealable with the wall.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

An internal combustion engine (not shown) includes a block and heads. Each of the heads includes intake and exhaust valves that introduce a fuel-air mixture into cylinders defined in the block and expel combusted gases from the cylinders, respectively. The valves are controlled by one or more camshafts. In an overhead valve (OHV) engine, the one or more camshafts are disposed within the engine block and can connect with the valves via valve lifters, pushrods and rocker arms. The one or more camshafts include lobes that engage with associated ones of the valve lifters to actuate the valves at the appropriate times. In other engine designs, the heads may include an overhead cam (OHC) configuration in which one camshaft (SOHC) or two camshafts (DOHC) are supported for rotation above the valves. Here, the lobes of the camshafts can engage with the valves via various valve train components including, but not limited to, rocker arms and bucket tappets.

Figure 1:
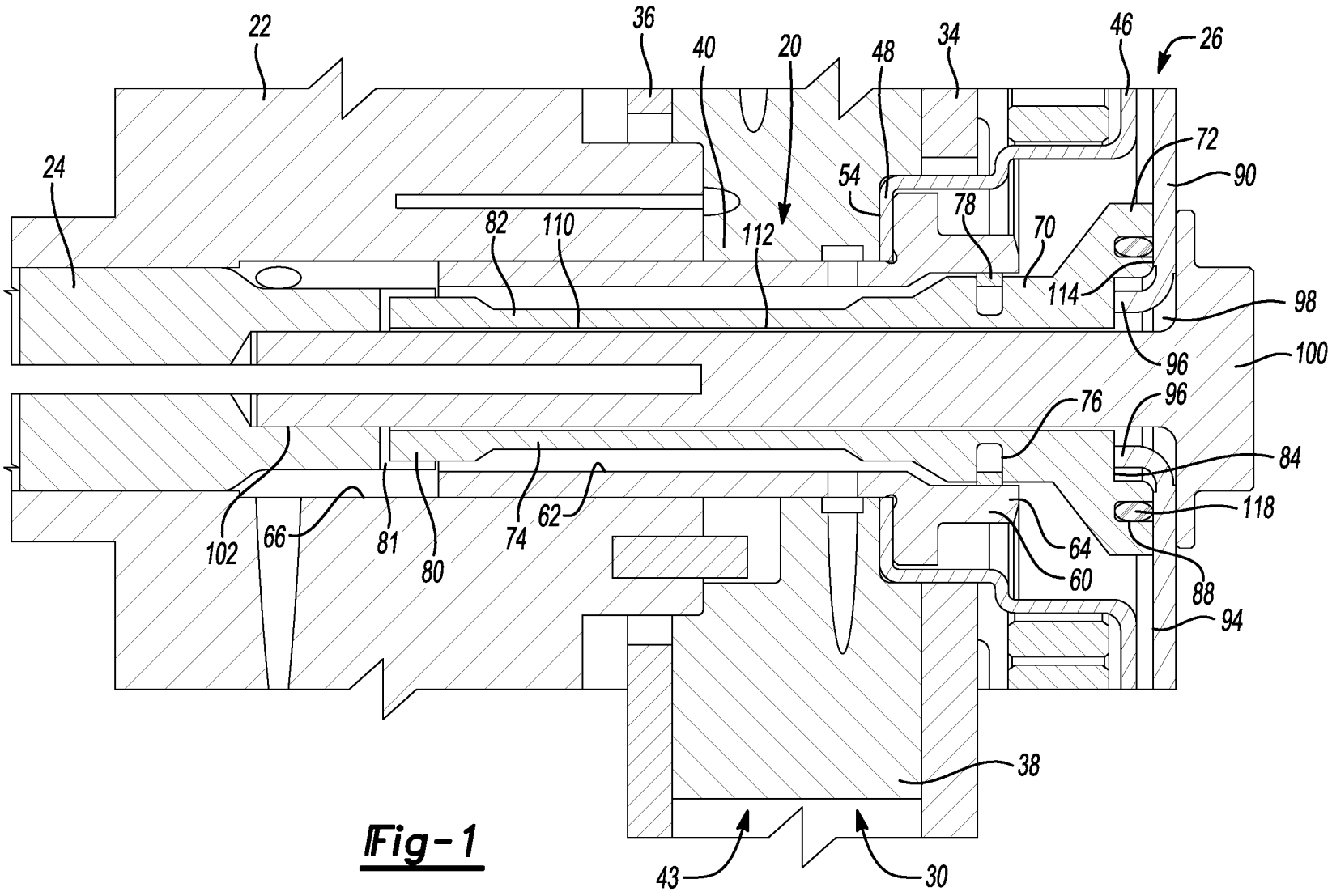
FIG. 1 is a cross-sectional view of a concentric camshaft assembly.

Referring to FIG. 1, a concentric camshaft assembly 20 includes an outer camshaft 22 and an inner camshaft 24 extending through a central bore of the outer camshaft 22. The inner and outer camshafts are supported for concentric rotation. The camshaft assembly 20 may be used in an OHV engine and are supported for rotation within the engine block. The inner and outer camshafts 22, 24 have lobes configured to engage with associated valve lifters. The inner camshaft 22 may control the intake valves and the outer camshaft 24 may control the exhaust valves, or vice versa in other embodiments. The camshaft assembly 20 may also be used in SOHC and DOHC engines.

Figure 2:
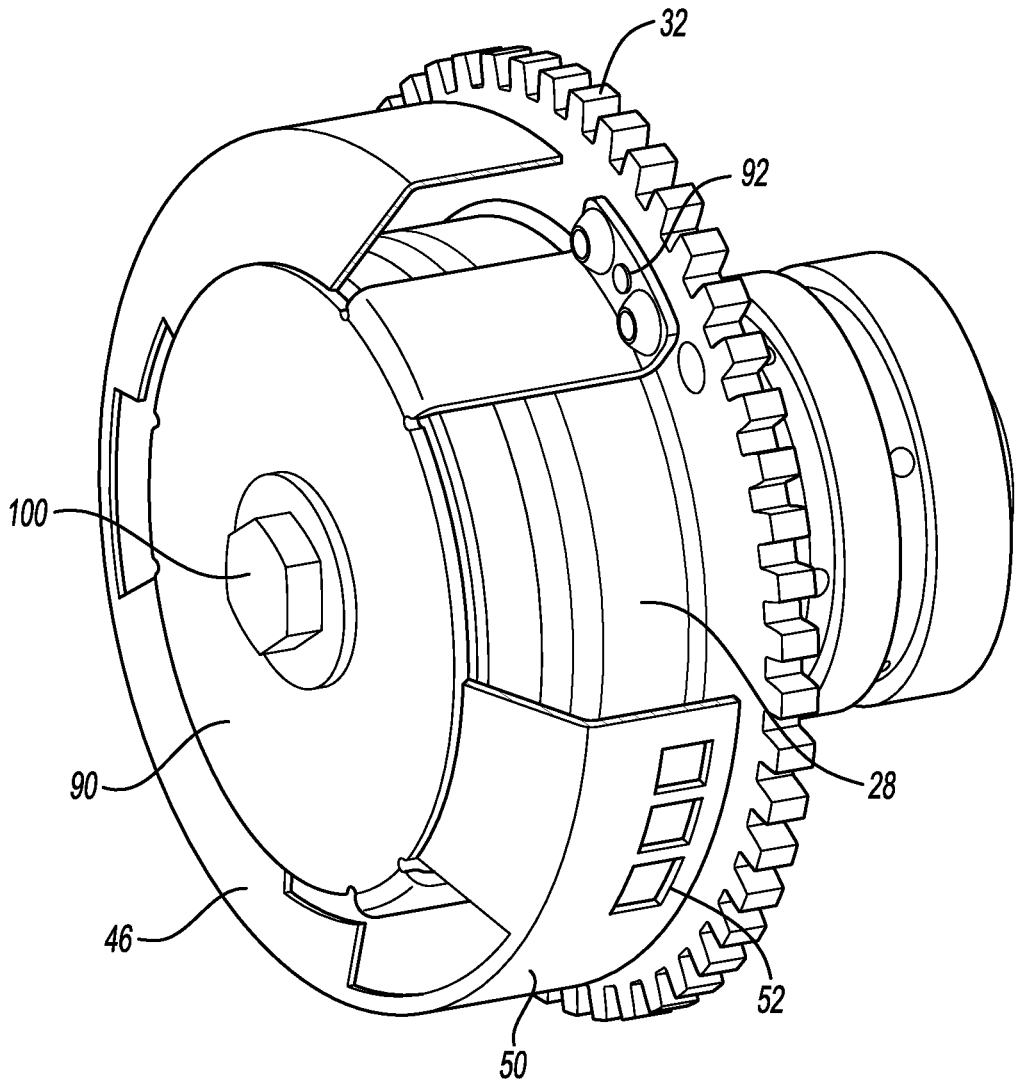
FIG. 2 is a front perspective view of a camshaft phaser of the concentric camshaft assembly.

Referring to FIGS. 1 and 2, the engine includes variable valve timing (VVT) in which the angular position (known as phase or phase angle) of one or both of the camshafts 22, 24 is modified relative to the crankshaft to advance and/or retard timing of valve events. The timing may be modified to increase engine performance, e.g. increase power, and/or improve fuel economy. The engine may include one or more camshaft phasers configured to change the phase of one or more camshafts. Each camshaft phaser may be associated with one or more camshafts. In the illustrated embodiment, a camshaft phaser 26 is associated with the camshaft assembly 20.

The camshaft phaser 26 may include an annular stator 28 defining a cavity 30. The stator 28 may include an outer circumferential wall and a pair of cover plates 34 and 36 that cooperate to define the cavity 30. The stator 28 may be drivably connected to the crankshaft by a tension member (typically a timing chain or timing belt) to be fixed rotationally relative to the crankshaft. In the illustrated embodiment, the stator 28 includes a sprocket 32 connected to the crankshaft with a timing chain. Of course, the sprocket 32 may be swapped with a pulley and the chain with a timing belt.

A rotor 38 is supported within the cavity 30 and is rotatable relative to the stator 28. The rotor 38 includes a hub 40 connectable to the outer camshaft 22 to be rotationally fixed relative to the camshaft 22. The camshaft phaser 26 changes phase angle of the outer camshaft 22 by rotating the rotor 38 relative to the stator 28. This changes the phase of the camshaft 22 relative to the crankshaft. The camshaft phaser 26 may be configured to rotate the rotor 38 forward relative to the stator 28 to advance timing and/or rotate the rotor 38 backwards relative to the stator to retard timing. The rotor 38 may be hydraulically operated. For example, the rotor 38 may define a plurality of vanes that cooperate with the stator 28 to define a plurality of chambers 43. The rotor 38 may define a plurality of fluid passageways in fluid communication with the chambers 43. The rotational position of the rotor 38 relative to the stator 28 can be modified by supplying and removing fluid from the chambers 43.

The camshaft phaser 26 includes a target wheel 46 connected to the rotor 38 and configured to be read by a camshaft position sensor (not shown) to determine the angular position of the outer camshaft 22. The camshaft sensor may be a hall-effect sensor or the like. The target wheel 46 may include a hub portion 48 and a skirt portion 50. The hub portion 48 may be disposed against a first radial face 54 of the rotor 38. The skirt portion 50 is generally circular with a plurality of features 52, such as teeth, notches, slots, gaps, holes etc., that are readable by the camshaft position sensor. The target wheel 46 is annually indexed to the rotor 38 (and likewise to the camshaft 22) so that the rotational position of the rotor 38 and camshaft 22 can be inferred by reading the target wheel 46 with the sensor.

The camshaft phaser 26 may be attached to the camshaft 22 by a fastener 60. The fastener 60 has a shank extending through central holes in the rotor 38 and the target wheel 46 and threadedly engages with a threaded bore 66 of the camshaft 22. The fastener 60 includes a head 64 that engages with the hub portion 48. The fastener 60 robustly secures the target wheel 46 to the rotor 38 and robustly secures the rotor 38 to the camshaft 22 so that these components rotate together. The fastener 60 may define fluid holes for supplying fluid to the cavity 30.

Figure 3:
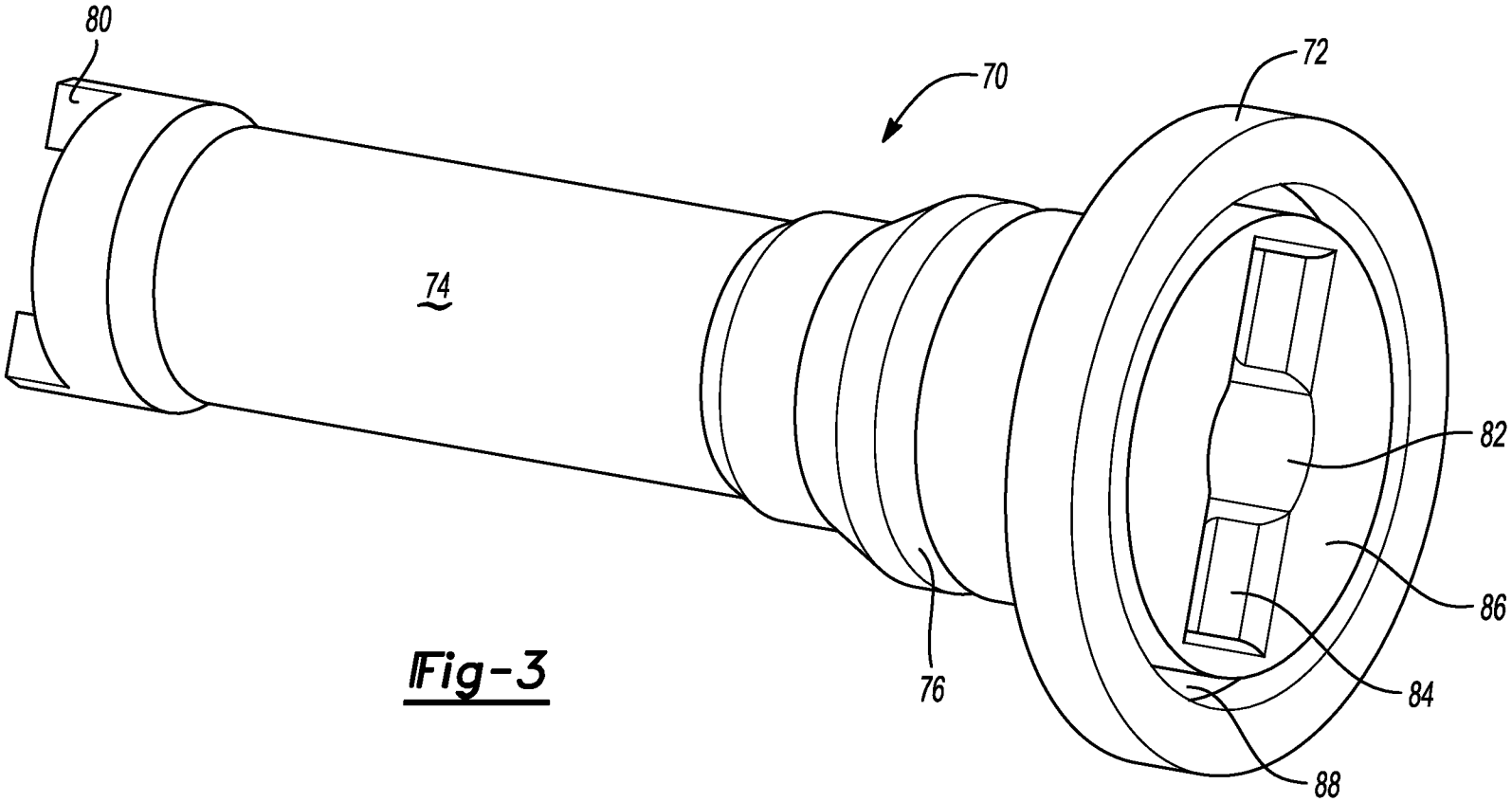
FIG. 3 is a perspective view of a drive adapter of the camshaft phaser.

Referring to FIGS. 1, 2, and 3, a drive adapter 70 drivably connects the inner camshaft 24 to the stator 28. The drive adapter includes a head 72 and a shank 74 extending through the hollow center 62 of the fastener 60. A distal end of the shank 74 includes prongs 80 that engage with cooperating features, e.g., receptacle 81, of the inner camshaft 24 to rotationally fix the drive adapter 70 and the inner camshaft 24. The shank 74 defines an annular groove 76 that receives a ring 78 that engages with a surface of the hollow center 62. The ring 78 may be metal.

The drive adapter 70 transfers power from a drive plate 90 to the inner camshaft 24. The drive plate 90 is fixed to the stator 28. For example, the drive plate 90 may include a plurality of anchor tabs 92 that are attached to the stator 28 such as by screws or the like. The drive plate 90 includes a radial wall 94 adjacent an end face 86 of the head 72. The radial wall 94 and the head 72 may include key features that rotationally couple the drive adapter 70 and the drive plate 90. The head 72 may include a first key 84 that engages with a second key 96 of the radial wall 94. The first key 84 may be a slot recessed into the end face 86, and the second key 96 may be a pair of tabs that project axially from the wall 94 and are received in the slot. The drive adapter 70 may be secured to the inner camshaft 22 by a fastener 100 that extends through a hole 98 of the drive plate 90 and a central bore 82 of the drive adapter 70. The fastener 100 threadably engages with a threaded bore 102 of the inner camshaft 24. The central bore 82 may extend through the first key 84.

The drive adapter 70 cooperates with the fastener 60 to define one or more oil passageways for the cavity 30. The clearance between the fastener 100 and the central bore 82 forms an oil leak path 110 having an axial portion 112 and a radial portion 114 between the radial wall 94 and the end face 86. A gasket 118 is provided to prevent oil from leaking between the drive plate 90 and the drive adapter 70. The drive adapter 70 may define a continuous groove 88 recessed into the end face 86. Used herein, "continuous groove" refers to a groove that has no ends. For example, the continuous groove 88 may be annular (as shown), rectangular, or any other closed polygonal shape. The gasket 118 has a shape that matches the shape of the groove 88 and is received therein. Thus, in the illustrated embodiment, the gasket 118 is annular. The groove 88 and the gasket 118 may circumscribe the first key 84 and the central bore 82. The gasket 118 engages with the radial wall 94 to inhibit oil leaking from the central bore 82.

Figure 4:
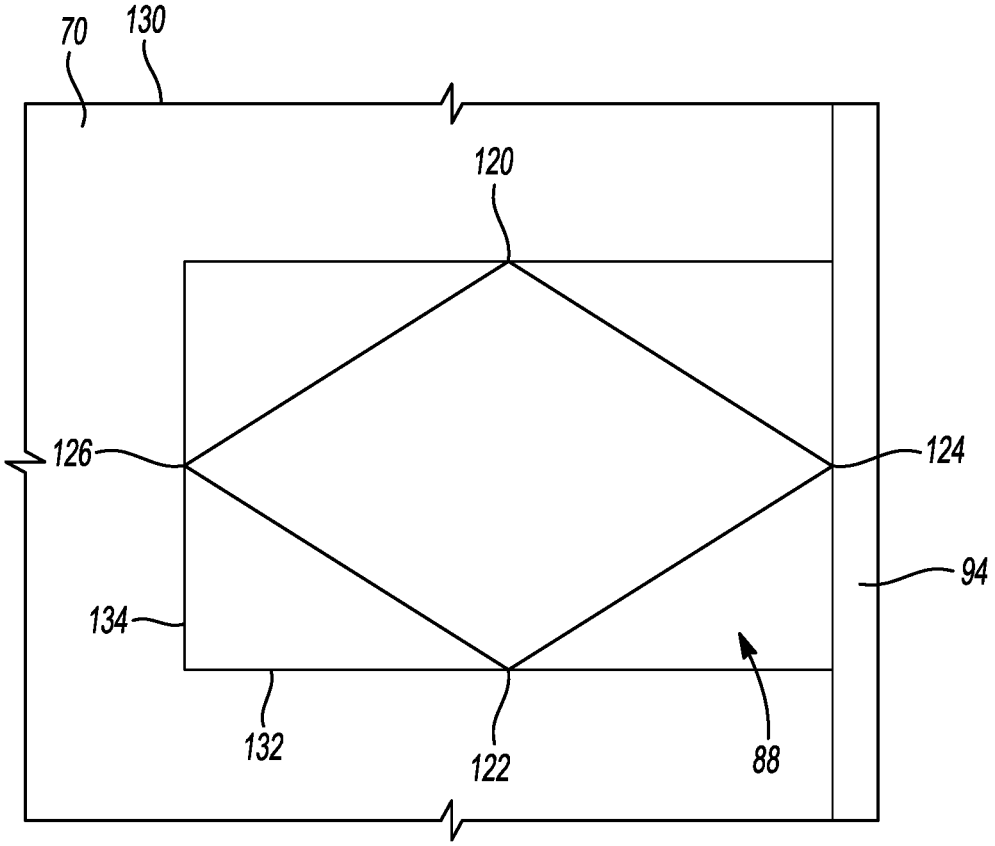
FIG. 4 is a detail view of a gasket seated on the drive adapter.

Referring to FIG. 4, the gasket 118 may have a diamond cross-sectional shape with opposing first and second edges 120, 122 and opposing third and fourth edges 124, 126. The gasket 118 may be received in the groove 88 with the first edge 120 disposed against an outer circumferential groove surface 130, the second edge 122 disposed against an inner circumferential groove surface 132, and the third edge 124 projecting axially to engage with the radial wall 94. The fourth edge 126 may or may not engage with a groove bottom 134. Of course, in other embodiments the gasket 118 may have a circular cross-sectional shape, a rectangular cross-sectional shape or the like.

The gasket and drive adapter of this disclosure provides a robust oil seal rather than relying on the drive plate to contain the oil. This allows more flexible design of the drive plate. For example, the drive plate need not form a complete enclosure to the stator to contain oil, and instead an open drive-plate design can be used to reduce weight and/or facilitate attachment of the trigger wheel.

While exemplary embodiments are described above, it is not intended that these embodiments describe all possible forms encompassed by the claims. The words used in the specification are words of description rather than limitation, and it is understood that various changes can be made without departing from the spirit and scope of the disclosure.

As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

PARTS LIST

20 concentric camshaft assembly
22 outer camshaft
24 inner camshaft
26 camshaft phaser
28 stator
30 cavity
32 sprocket
34 cover plate
36 cover plate
38 rotor
40 hub
43 chambers
46 target wheel
48 hub portion
50 skirt portion
52 features
54 first radial face
60 fastener
62 hollow center
64 head
66 bore
70 drive adapter
72 head
74 shank
76 annular groove
78 ring
80 prongs
81 receptacle
82 central bore
84 first key
86 end face
88 groove
90 drive plate
92 anchor tabs
94 radial wall
96 second key
98 hole
100 fastener
102 bore
110 oil leak path
112 axial portion
114 radial portion
118 gasket
120 first edge
122 second edge
124 third edge
126 fourth edge
130 outer circumferential groove surface
132 inner circumferential groove surface
134 groove bottom

What is claimed is:

1. A camshaft phaser for a concentric camshaft assembly comprising:

a stator defining a cavity and configured to receive power from an engine crankshaft;

a rotor supported within the cavity and rotatable relative to the stator;

a drive adapter including a shank and a head, the shank being extendable through the rotor and configured to engage with an inner camshaft, the head having an end face defining a first key feature and a continuous groove;

a drive plate fixed to the stator and including a radial wall defining a second key feature engageable with the first key feature to rotationally fix the drive adapter to the drive plate; and an annular gasket received in the groove and sealable with the wall.

2. The camshaft phaser of claim 1, wherein the groove circumscribes the first key feature.

3. The camshaft phaser of claim 1, wherein the first key feature is a recessed slot and the second key feature is at least one projection extending from the wall and receivable in the recessed slot.

4. The camshaft phaser of claim 1, wherein the gasket has a diamond cross-sectional shape and has opposing first and second edges and opposing third and fourth edges.

5. The camshaft phaser of claim 4, wherein the groove has an outer circumferential surface and an inner circumferential surface, and wherein the gasket is received in the groove with a first edge disposed against the outer surface, a second edge disposed against the inner surface, and the third edge projecting axially to engage with the radial wall.

6. The camshaft phaser of claim 1, wherein the drive adapter defines a central bore configured to receive a fastener, wherein the annular gasket circumscribes the bore to restrict flow of fluid in the bore.

7. The camshaft phaser of claim 1, wherein the shank includes at least one prong configured to engage with a receptacle of the inner camshaft.

8. The camshaft phaser of claim 1 further comprising a fastener extendable through the rotor and configured to secure the rotor to an outer camshaft.

9. The camshaft phaser of claim 8, wherein the shank of the drive adapter is extendable through a central bore of the fastener.

10. The camshaft phaser of claim 1, wherein the groove is circular and the gasket is annular.

11. A camshaft phaser comprising:

a stator defining a cavity and configured to receive power from an engine crankshaft;

a rotor supported within the cavity and rotatable relative to the stator, wherein the rotor is configured to be rotationally fixed to an outer camshaft so that rotation of the rotor relative to the stator adjusts a phase angle of the outer camshaft;

a drive adapter including a shank extending through the rotor and configured to be rotationally fixed to an inner camshaft, the drive adapter further including a head having an end face defining a first key feature and a continuous groove;

a drive plate fixed to the stator and including a radial wall defining a second key feature engaged with the first key feature to rotationally fix the drive adapter to the drive plate so that the inner camshaft is rotatable with the stator; and a gasket received in the groove and disposed against the wall.

12. The camshaft phaser of claim 11, wherein the gasket has a diamond cross-sectional shape and has opposing first and second edges and opposing third and fourth edges.

13. The camshaft phaser of claim 12, wherein the groove has an outer circumferential surface and an inner circumferential surface, and wherein the gasket is received in the groove with a first edge disposed against the outer surface, a second edge disposed against the inner surface, and the third edge projecting axially to engage with the radial wall.

14. The camshaft phaser of claim 11, wherein the groove is circular and the gasket is annular.

15. The camshaft phaser of claim 11, wherein the groove circumscribes the first key feature, and the first key feature is a recessed slot and the second key feature is at least one projection extending from the wall and received in the recessed slot.

16. The camshaft phaser of claim 11 further comprising:

a first fastener with a hollow center extending through the rotor and threadably engageable with the outer camshaft to rotationally fix the rotor to an outer camshaft, wherein the shank of the drive adapter extends through the hollow center; and a second fastener extending through a central bore of the drive adapter and threadably engageable with the inner camshaft.

17. The camshaft phaser of claim 16, wherein the gasket circumscribes the central bore to restrict flow of fluid between the end face and the radial wall of the drive plate.

18. A camshaft phaser comprising:

a stator;

a rotor configured to engage with an outer camshaft;

a drive adapter extendable through the rotor, configured to engage with an inner camshaft, and including a head defining a groove and a first key feature;

a drive plate rotationally fixable to the stator and including a radial wall defining a second key feature engageable with the first key feature to rotationally fix the drive adapter to the drive plate; and a gasket received in the groove and sealable with the radial wall.

19. The camshaft phaser of claim 18, wherein the groove is circular and the gasket is annular.

20. The camshaft phaser of claim 18, wherein the head has an end face that defines the first key feature and the groove.

* * * * *